US009913503B2

(12) United States Patent
Rapp

(10) Patent No.: US 9,913,503 B2
(45) Date of Patent: Mar. 13, 2018

(54) POCKET WITH RECESSED INTERNAL ZIPPER

(71) Applicant: CLOTHING ARTS, LTD., North Woodmere, NY (US)

(72) Inventor: Adam Rapp, Brooklyn, NY (US)

(73) Assignee: CLOTHING ARTS, LTD., North Woodmere, NY (US)

( * ) Notice: Subject to any disclaimer, the term of this patent is extended or adjusted under 35 U.S.C. 154(b) by 0 days.

(21) Appl. No.: 14/881,756

(22) Filed: Oct. 13, 2015

(65) Prior Publication Data

US 2017/0099897 A1 Apr. 13, 2017

(51) Int. Cl.
*A41D 27/20* (2006.01)

(52) U.S. Cl.
CPC ..... *A41D 27/202* (2013.01)

(58) Field of Classification Search
CPC ..... A41D 1/06; A41D 27/201
See application file for complete search history.

(56) References Cited

U.S. PATENT DOCUMENTS 1,787,706 A * 1/1931 Stember ..... A41D 27/201 206/466
2,224,734 A * 12/1940 Kopf ..... A41D 27/201 2/253
2,291,414 A * 7/1942 Slobotkin ..... A41D 27/201 2/254
5,165,115 A * 11/1992 Stanislaw ..... A41D 27/208 2/247
5,255,392 A * 10/1993 Stanislaw ..... A41D 27/208 2/247
6,571,432 B1 * 6/2003 Rindle ..... A41D 27/201 24/389
6,760,926 B1 * 7/2004 Miller ..... A41D 27/201 2/250
2005/0251896 A1 * 11/2005 Donlan ..... A41D 1/06 2/269
2008/0256689 A1 * 10/2008 Grilliot ..... A41D 13/0012 2/455
2013/0298312 A1 * 11/2013 Rapp ..... A41D 27/201 2/252
2014/0026294 A1 * 1/2014 Holland ..... A41D 10/00 2/228
2014/0102050 A1 * 4/2014 Lamper ..... A41D 27/201 53/476
2014/0259270 A1 * 9/2014 Lepovitz ..... A41D 27/20 2/69
2014/0259299 A1 * 9/2014 Sievwright ..... A41D 27/20 2/252
2015/0101108 A1 * 4/2015 Wallace ..... A41D 27/208 2/251

* cited by examiner

*Primary Examiner* — Shaun R Hurley
*Assistant Examiner* — Andrew W Sutton
(74) *Attorney, Agent, or Firm* — Gottlieb, Rackman & Reisman, P.C.

(57) ABSTRACT

A configuration for a garment that includes a pocket with a recessed zipper that may be virtually invisible (especially when the wearer uses the pocket to store only a few, relatively flat objects). A portion of the pocket extends above the zipper closing the pocket so that a pickpocket has to reach into the pocket before he realizes that there is a zipper protecting it. In other words, the zipper is recessed from an edge of the pocket to form a hidden means of sealing the pocket.

12 Claims, 3 Drawing Sheets

POCKET WITH RECESSED INTERNAL ZIPPER

FIELD OF THE INVENTION

This invention pertains to a garment such as a pair of pants with at least one pocket protected by a zipper. Importantly the zipper is spaced away from the pocket edge or recessed so that it is not visible.

BACKGROUND OF THE INVENTION

Pockets with zippers are well known in the art of fashion and garment design. The zipper may have two functions: it may be viewed as interesting and unusual design feature on a garment and/or can be used as a means to protect the contents of the pocket. One problem with these kinds of pockets is that the zipper is very clearly visible to a potential pickpocket and can be easily opened without the knowledge of the garment wearer. This is especially true if the pocket is a back pocket on pants.

A further problem with existing pockets with zippers is that the way such pockets are constructed results in several layers of materials at one or both sides of the zipper forming a visible line that is esthetically objectionable.

SUMMARY OF THE INVENTION

The present disclosure is directed to a configuration for a garment that includes a pocket with a recessed zipper that may be virtually invisible (especially when the wearer uses the pocket to store only a few, relatively flat objects). However, there is a portion of the pocket extends above the zipper closing the pocket so that a pickpocket has to reach into the pocket before he realizes that there is a zipper protecting it. The configuration presented herein is particularly suitable to jeans that have a 2-4 inch strip at the top because the zipper can be attached at the seam below this strip.

DETAILED DESCRIPTION OF EMBODIMENTS OF THE INVENTION

Figure 1:
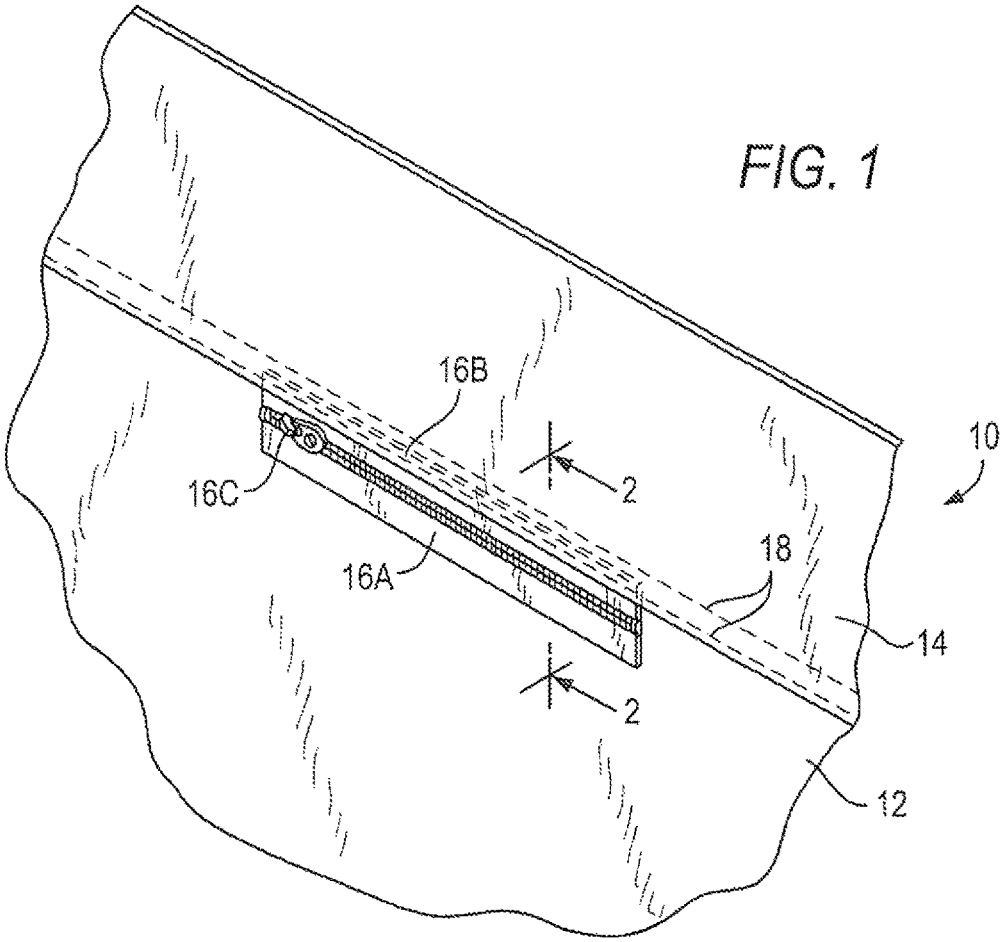
FIG. 1 shows a somewhat orthogonal sectional internal view of a portion of a garment with a recessed zipper constructed in accordance with this invention.

As previously mentioned, the present invention is particularly useful on a pair of jeans. FIG. 1 shows a partial view of a pair of jeans 10 formed of at least two components: a main panel 12 and an upper strip 14. A zipper 16 is also provided having two generally horizontal tapes 16A, 16B (lower tape 16A and upper tape 16B) that are selectively joined by a handle 16C in a conventional manner.

Figure 2:
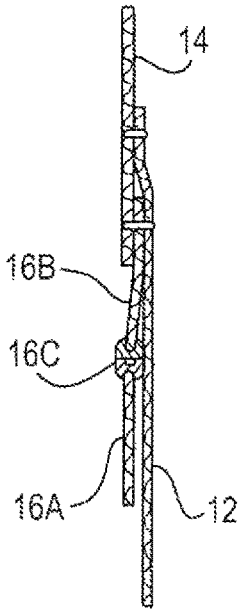
FIG. 2 shows a side sectional of the garment portion of FIG. 1.

These three components are assembled as follows. First the upper tape 16B is sewn to the lower edge of upper strip 14. The upper strip 14 is then joined to the main panel 12 by a double sewing line 18. As can be seen in FIGS. 1 and 2, the lower tape 16A hangs free and is not yet attached to anything.

Figure 3:
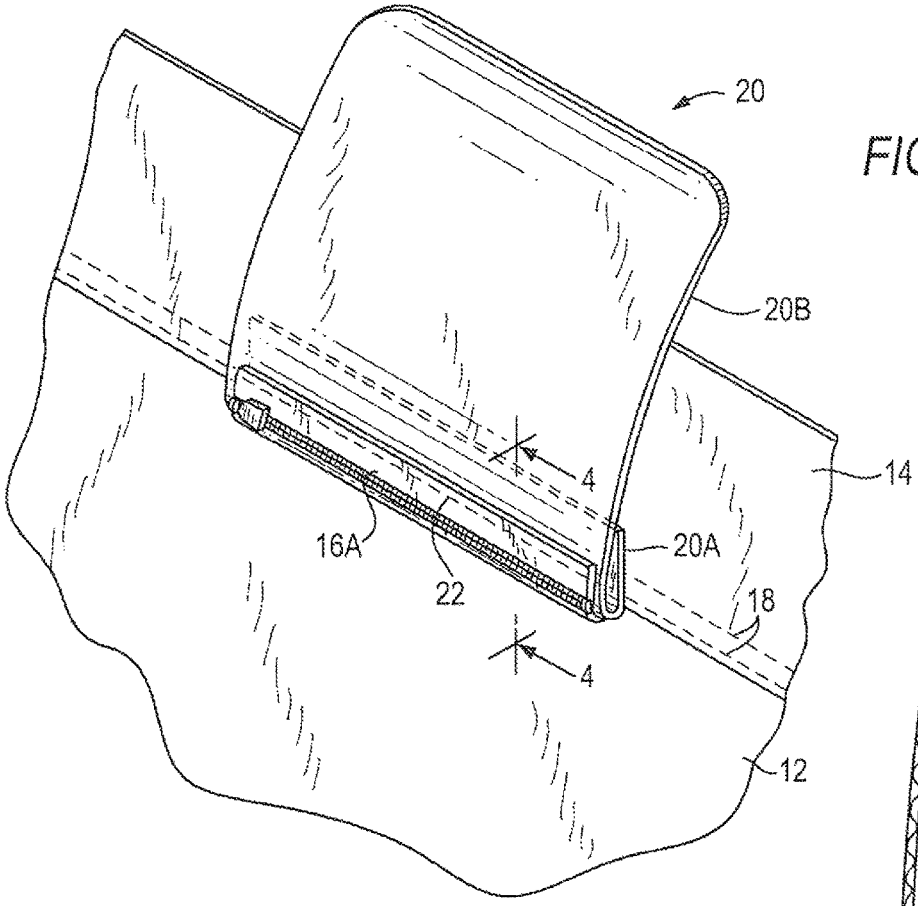
FIG. 3 shows an orthogonal view of the pocket panel being attached to the garment component of FIGS. 1 and 2.
Figure 4:
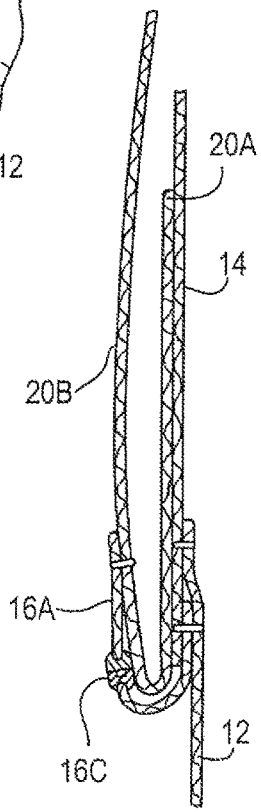
FIG. 4 shows a side sectional view of the pocket panel being attached to the garment component of FIG. 4.

Next, a small pocket panel 20 is first sewn to the lower tape 16A. For example, the pocket panel 20 is folded in two with a smaller portion 20A being disposed under the larger portion 20B. The panel 20 is then placed on top of the zipper 16 and lower tape 16A is folded over the smaller portion 20A as seen in FIGS. 3 and 4. The larger portion 20B is then sewn to the lower tape 16A using a sewing line 22.

The larger portion 20B is folded back so that portions 20A and 20B are generally coplanar. Next, the pocket panel 20 is sewn to the main panel 12 and the strip 14 leaving a top edge 24 unattached. In this manner the pocket panel 20 forms a pocket 26 on the garment 10 with an opening 28 between the edge 24 and the strip 14. The zipper 16 is disposed below the edge 24 by about ½ to 1½ inches and provides a closing means for the pocket 26. Additionally, a button 30 may be provided as a further means of closing the pocket 26.

Figure 5:
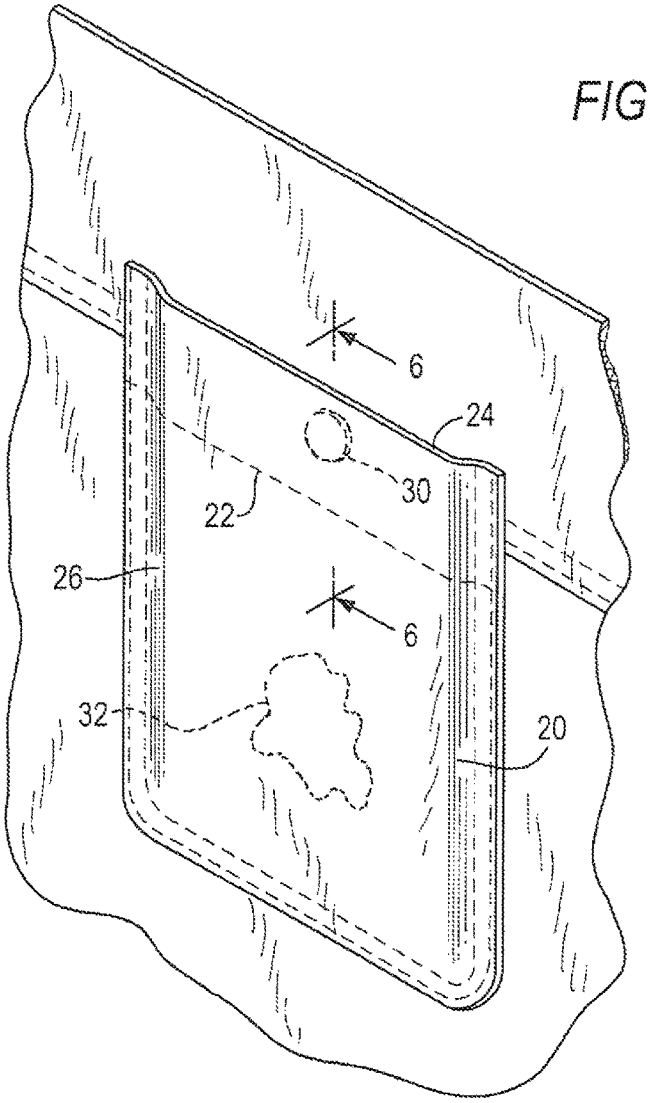
FIG. 5 shows an orthogonal view of the garment with the outer pocket having the recessed zipper.
Figure 6:
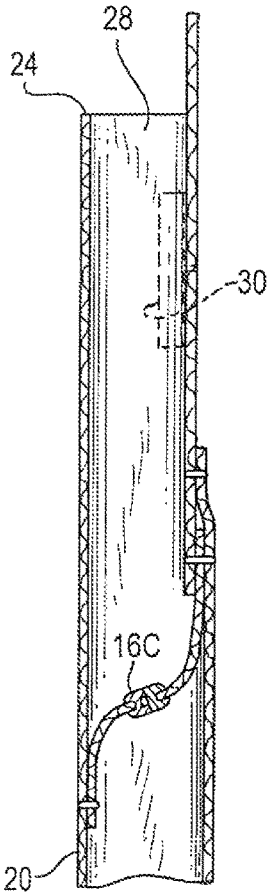
FIG. 6 shows a side sectional view of the garment component with the outside pocket and a recessed zipper.

Preferably, the garment 10 or at least pocket panel 20 is made of a somewhat elastic material. Therefore, when the pocket 26 is empty or contains only one or more small flat items, such as money or a passport, the pocket 26 stretches over the main panel 12 and remains flat so that the zipper is oriented vertically and is essentially invisible. If a larger object 32, such as a wallet, is placed in the pocket 26, the pocket 26 will bulge out slightly as seen in FIGS. 5 and 6. Access to the pocket interior is allowed only if the zipper 16 and button 30, if provided, are opened.

Numerous modifications may be made to this invention without departing from its scope as set forth in the appended claims.

I claim:

1. A garment comprising:

a component including a main panel having an upper edge and a strip having an upper edge and a lower edge;

a zipper including a first zipper tape, a second zipper tape spaced from the first zipper tape and a handle arranged to selectively join the first zipper tape and the second zipper tape, a front surface of the first zipper tape being fixed to the lower edge of the strip along a first sewing line and a rear surface of the first zipper tape being fixed along a second sewing line to the main panel; and a single pocket panel having a body delimited at a top edge, a bottom edge that is spaced from the top edge, a first side edge extending between the top edge and the bottom edge and a second side edge that is spaced from the first side edge extending between the top edge and the bottom edge, a region of the body fixed to the second zipper tape with the top edge extending above the region of the body fixed to the second zipper tape and the first side edge, the second side edge and the bottom edge fixed to the component to form a pocket for the garment with the top edge unattached to and spaced from the garment, forming an opening between the pocket panel and the component and the zipper being recessed from the top edge of the pocket panel while extending between the pocket panel and the component, forming a pocket having a first region extending from the top edge of the pocket panel above the zipper and a second region below the zipper.

2. The garment of claim 1, wherein said garment is a pair of jeans.

3. The garment of claim 1, wherein said unattached edge extends generally horizontally and said zipper is disposed horizontally below said unattached edge.

4. A pair of jeans, comprising:

a component including a main panel having an upper edge and a strip having an upper edge and a lower edge;

a zipper including a first zipper tape, a second zipper tape spaced from the first zipper tape and a handle arranged to selectively join the first zipper tape and the second zipper tape, a front surface of the first zipper tape being directly fixed to the lower edge of the strip along a first sewing line and a rear surface of the first zipper tape being directly fixed along a second sewing line to the main panel; and a single pocket panel having a body delimited at a top edge, a bottom edge that is spaced from the top edge, a first side edge extending between the top edge and the bottom edge and a second side edge that is spaced from the first side edge and extends between the top edge and the bottom edge, a region of the body fixed directly to the second zipper tape with the top edge extending above the region of the body fixed to the second zipper tape and the first side edge, the second side edge and the bottom edge fixed directly to the component to form a pocket for the garment with the top edge spaced from the garment forming a generally horizontal opening between the pocket panel and the component and the zipper being recessed from the top edge of the pocket panel while extending between the pocket panel and the component, forming a pocket having a first region extending from the top edge of the pocket panel above the zipper and a second region below the zipper.

5. The pair of jeans of claim 4, further including a second closing member for selectively closing the pocket opening.

6. The pair of jeans of claim 5, wherein the second closing member includes a button.

7. The garment of claim 1, wherein said first zipper tape is disposed a predetermined distance below the top edge of the pocket panel.

8. The garment of claim 7, wherein said first zipper tape is disposed at least 2 inches below the top edge of the pocket panel.

9. The pair of jeans of claim 4, wherein said first zipper tape is disposed a predetermined distance below the top edge of the pocket panel.

10. The pair of jeans of claim 9, wherein said first zipper tape is disposed at least 2 inches below the top edge of the pocket panel.

11. The garment of claim 1, wherein the front surface of the first zipper tape is fixed to a rear surface of the lower edge of the strip along a sewing line and the rear surface of the first zipper tape is fixed along a sewing line to a front surface of the main panel.

12. The garment of claim 1, wherein the first region and the second region of the pocket extend along a same plane.

* * * * *